United States Patent [19]

Nakamura et al.

[11] 4,363,621

[45] Dec. 14, 1982

[54] OIL BURNER OF TYPE OF PUMPING UP FUEL OIL

[75] Inventors: Kazuharu Nakamura; Motoki Matsumoto; Akinobu Kondo, all of Nagoya, Japan

[73] Assignee: Toyotomi Kogyo Co., Ltd., Nagoya, Japan

[21] Appl. No.: 158,534

[22] Filed: Jun. 11, 1980

[51] Int. Cl.[3] ..... F23K 5/00

[52] U.S. Cl. ..... 431/90; 431/333; 137/209; 137/563; 137/577

[58] Field of Search ..... 431/90, 118, 195–201, 431/331–342; 137/209, 563, 577

[56] References Cited

U.S. PATENT DOCUMENTS

| | | | |
|---|---|---|---|
| 1,610,169 | 12/1926 | Schreiner | 137/577 |
| 2,101,424 | 12/1937 | Bennett | 431/334 |
| 3,274,985 | 9/1966 | Traver et al. | 137/577 |

FOREIGN PATENT DOCUMENTS

| | | | |
|---|---|---|---|
| 726495 | 1/1966 | Canada | 431/90 |
| 44-30309 | 12/1969 | Japan . | |
| 52-3735 | 12/1977 | Japan | 431/333 |
| 55-53609 | 4/1980 | Japan | 431/90 |

*Primary Examiner*—Samuel Scott
*Assistant Examiner*—Lee E. Barrett
*Attorney, Agent, or Firm*—Pollock, Vande Sande & Priddy

[57] ABSTRACT

An oil burner of the type of pumping up a fuel oil is disclosed which has a first oil level setting means of an airtight type having an overflow pipe means constantly immersed at the lower end thereof in a fuel oil to be pumped up to the first oil level setting means and has a second oil level setting means disposed below the first oil level setting means and directly connected to a fuel oil supply tank. A fuel oil supplied from the second oil level setting means is drawn up to the first oil level setting means by a pumping-up means and subsequently supplied through a supply pipe to a combustion means. The level of a fuel oil in the first oil level setting means is kept constant at a position above the outlet end of the supply pipe. The overflow pipe means may be movable in the vertical direction so as to vary only the supply rate of a fuel oil.

18 Claims, 5 Drawing Figures

OIL BURNER OF TYPE OF PUMPING UP FUEL OIL

BACKGROUND OF THE INVENTION

1. Field of the Invention

This invention relates to an oil burner of the type of pumping up a fuel oil such as kerosene, and more particularly to an oil burner capable of allowing the flow rate of an air and the supply rate of a fuel oil to be proportionally controlled with respect to each other.

2. Description of the Prior Arts

In an oil burner of the type of controlling the flow rate of an air and the supply rate of a fuel oil to be supplied to a combustion means, an oil level setting means is airtightly constructed and is communicated at the upper space portion thereof through a ramification pipe to an air duct for supplying an air to the combustion means, so that the supply rate of a fuel oil is controlled proportionally to the flow rate of an air. Such conventional oil burner is disclosed in Japanese Utility Model Publication No. 30309/69. However, such conventional oil burner is constructed to directly set the level of a fuel oil in an oil level setting means by the pressure of an air forced by a fan with respect to the position of a combustion means. Thus, when a fan of the type of supplying a large amount of air under a low pressure such as a multiblade fan is incorporated in such conventional oil burner, it has been required to keep the surface of a fuel oil in an oil level setting means at a high level with respect to a combustion means; and further, in view of the flow resistance of a fuel oil, it has been required to set the level of a fuel oil at a very high position with respect to a combustion means. However, such construction has a disadvantage of often causing a fuel oil to spill in a combustion means when tilting an oil burner at the time of, for example, moving it. When a fuel oil spills in a combustion means, it becomes impossible to burn a fuel oil unless the spilt oil is completely gasificated during a process of preheating a fuel oil; because the fuel oil supplied to the combustion means does not reach a temperature sufficient to be burned. Further, the gasification of the spilt oil causes an offensive odor to be emitted. Accordingly, it is generally required to disassemble an oil burner to wipe up the spilt oil. In order to avoid such trouble, it has been required to provide a pipe for supplying a fuel oil from an oil level setting means to a combustion means with an on-off valve, this resulting in the construction and operation of an oil burner being complicated. In addition, such construction has a further disadvantage that the on-off valve remains open where it is choked with foreign substances such as a dust and the like contained in a fuel oil, to thereby prevent the normal operation of an oil burner.

While, when a fan of the type of supplying a small amount of air under a high pressure such as a turbofan is incorporated in such conventional oil burner as mentioned above, it is possible to obtain a pressure sufficient to forcedly supply a fuel oil to a combustion means even if the level of a fuel oil in an oil level setting means is set at a low position with respect to the combustion means, to thereby prevent the spill of a fuel oil in the combustion means as mentioned above without providing an oil supply pipe with an on-off valve. However, such fan of supplying a small amount of air under a high pressure has a disadvantage of generating a loud noise as encountered with an electric cleaner and the like. Further, such fan has an additional disadvantage of making the control of flow rate of an air difficult due to the fact that an air is supplied under a high pressure, so that it has been difficult to obtain the optimum balance between the flow rate of an air and the supply rate of a fuel oil. In order to obtain the optimum balance, it is required to use an oil level setting means constructed to prevent the leakage of an air under a high pressure, this resulting in the manufacturing costs for an oil burner being increased. In addition, an oil burner incorporating such fan therein is generally adapted to restrict the supply rate of a fuel oil by greatly restricting the flow rate of an air, however, this results in the lack of an air in a slight combustion. In order to prevent the incomplete combustion, it is required to supply an air to a combustion means by means of a by-pass line, to thereby control the overall flow rate of an air; however, such construction requires to finely control the flow rate of an air and the supply rate of a fuel oil by means of an airtight damper of a high precision provided in the by-pass line, to thereby cause the manufacturing costs for an oil burner to be increased as well to cause the construction to be complicated.

Further, there has been also used an oil burner of the type of simultaneously controlling the flow rate of an air and the supply rate of a fuel oil. Such additional prior art oil burner is constructed in such a manner that a means for adjusting the supply rate of a fuel oil is airtightly constructed and is adapted to receive a pressure generated in a combustion chamber so as to supply a suitable amount of fuel oil to the combustion chamber in accordance with the variation in pressure in the combustion chamber caused due to the variation in air pressure applied on the top portion of an exhaust cylinder, to thereby prevent an abnormal combustion. However, as an airtight means for adjusting the supply rate of a fuel oil to be used in such conventional oil burner, it has been impossible to use an adjusting means of a type other than a floating type.

BRIEF SUMMARY OF THE INVENTION

The present invention is intended to eliminate the above-mentioned disadvantages of the prior art.

Accordingly, it is an object of the present invention to provide an oil burner capable of easily controlling the flow rate of an air and the supply rate of a fuel oil, of preventing the spill of a fuel oil without using an on-off valve, and of remarkably restraining the generation of a noise.

It is another object of the present invention to provide an oil burner capable of proportionally controlling the supply rate of a fuel oil with respect to the flow rate of an air, of varying the supply rate of a fuel oil without changing the flow rate of an air.

It is a further object of the present invention to provide an oil burner easily manufactured by combining economical parts such as an airtight oil level setting means of a type other than a floating type, a multiblade fan, an oil pumping-up means of a low precision and the like.

According to the present invention, there is provided an oil burner comprising a combustion means; an air supply means for supplying an air to the combustion means; a first oil level setting means of an airtight type for keeping the surface of a fuel oil introduced therein constant at a predetermined level, the first oil level setting means including a fuel oil reservoir connected through a fuel oil supply pipe to the combustion means and communicated at the upper space portion thereof through a ramification pipe to the air supply means so that the pressure of an air flowing through the air supply means may be applied onto the surface of a fuel oil in the reservoir; a second oil level setting means installed at a position below the first oil level setting means which keeps the surface of a fuel oil therein substantially constant at a predetermined level; a pumping-up means for drawing up a fuel oil supplied from the second oil level setting means to the first oil level setting means; the first oil level setting means further including an overflow pipe means connected to the reservoir which has a portion for overflowing an excess of fuel oil introduced in the reservoir positioned below the end of the fuel oil supply pipe extending into the combustion means and has a lower end immersed in a fuel oil to be pumped up to the first oil level setting means. An oil burner of the present invention is further characterized in that the overflow pipe means slidably connected to the reservoir to be moved in the vertical direction with respect to the reservoir, to thereby allow the rate of a fuel oil to be supplied to the combustion means to be varied as desired without changing the rate of an air flowing through the air supply means as well as to allow the rate of a fuel oil to be supplied to the combustion means to be controlled proportionally to the rate of an air flowing through the air supply means.

BRIEF DESCRIPTION OF DRAWINGS

These and other objects and many of the attendant advantages of this invention will be readily appreciated as the same becomes better understood by reference to the following detailed description when considered in connection with the accompanying drawings in which like reference numerals designate like or corresponding parts throughout, wherein.

DETAILED DESCRIPTION OF THE PREFERRED EMBODIMENT

Figure 1:
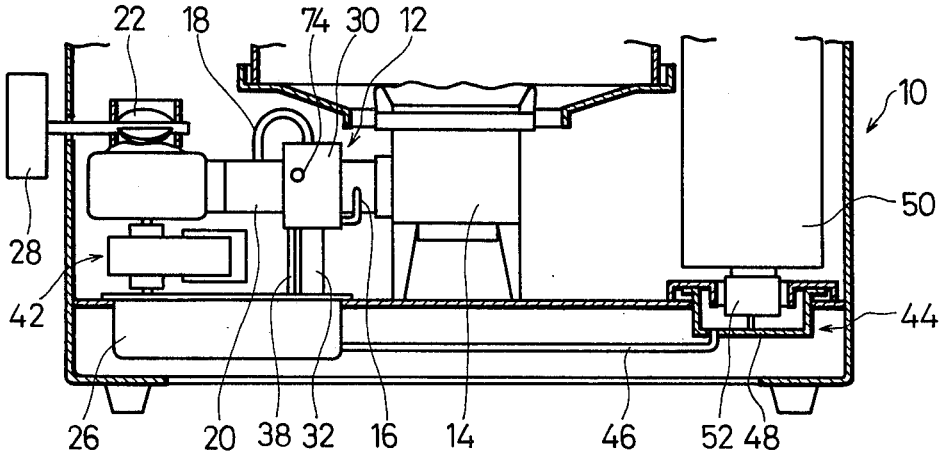
FIG. 1 is an elevational view partly in section showing one embodiment of an oil burner according to the present invention.
Figure 2:
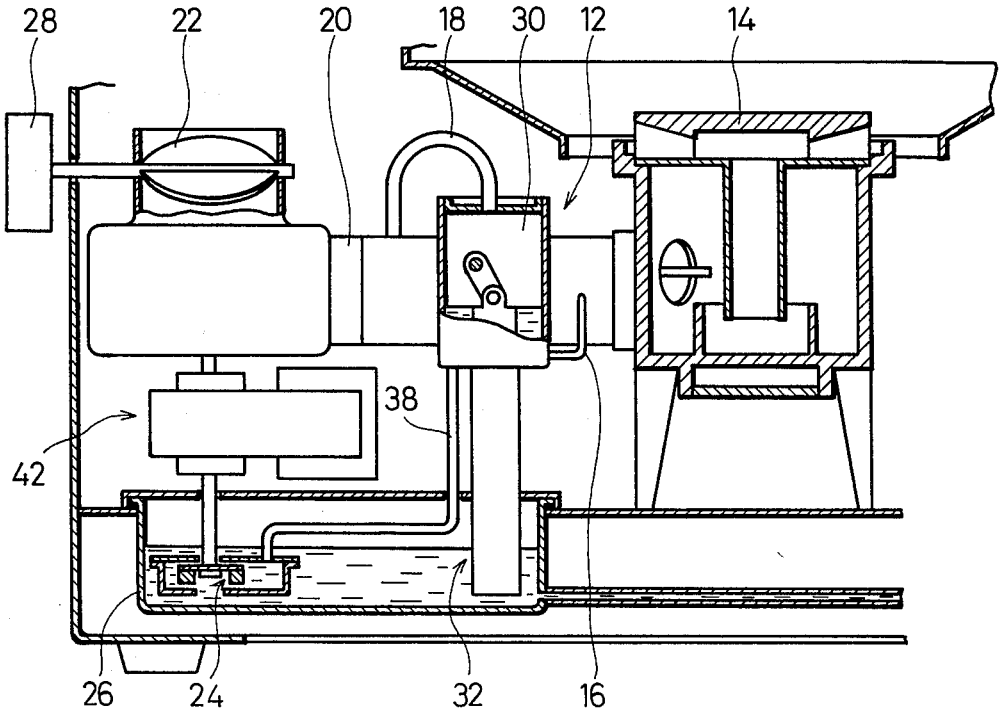
FIG. 2 is an enlarged vertical sectional view showing the essential portion of the oil burner of FIG. 1.

FIGS. 1 to 4 illustrates one embodiment of an oil burner according to the present invention in which an oil burner is generally designated by reference numeral 10. The oil burner 10 includes a first oil level setting means 12 for keeping the level of a fuel oil such as kerosene introduced therein constant at a predetermined height and a fuel oil combustion means 14. The first oil level setting means 12 is connected to the combustion means 14 through a fuel oil supply pipe 16; and is airtightly constructed as detailedly explained hereinafter, except that the upper space portion thereof is communicated through a ramification pipe 18 to an air duct 20. The air duct 20 is connected at one end thereof to the combustion means 14 and is connected at the other end thereof through a damper means 22 to a fan (not shown), to thereby supply an air to the combustion means 14; the damper means 22 being adapted to control the flow rate of an air to be supplied to the combustion means 14 and to apply an appropriate air pressure through the ramification pipe 18 onto the surface of a fuel oil introduced in the first oil level setting means 12. Reference numeral 24 designates a fuel oil pumping-up means which acts to draw up a fuel oil from a fuel oil storage tank 26 into the first oil level setting means 12. Reference numeral 28 indicates a knob for operating the damper means 22.

Figure 3:
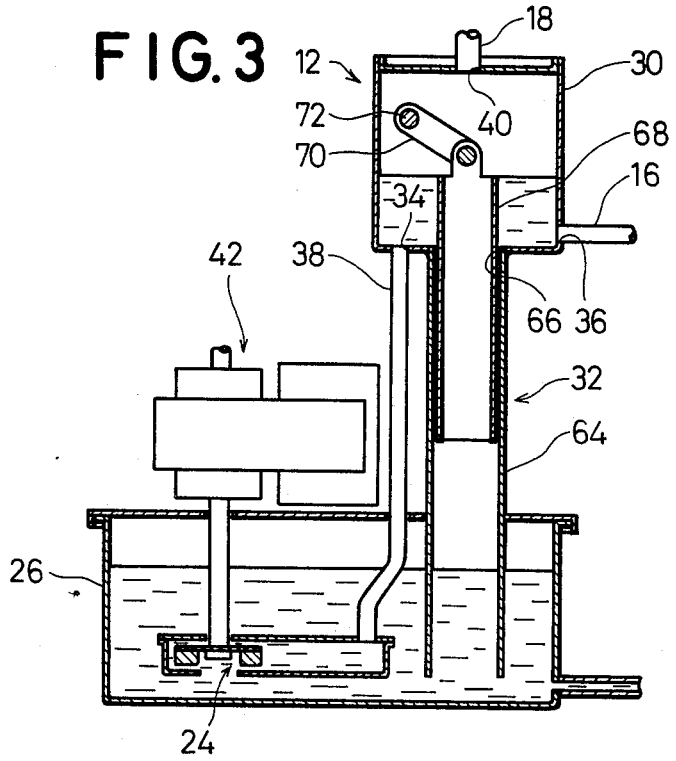
FIG. 3 is an enlarged detailed vertical sectional view showing a first oil level setting means incorporated in the oil burner of FIG. 1.
Figure 4:
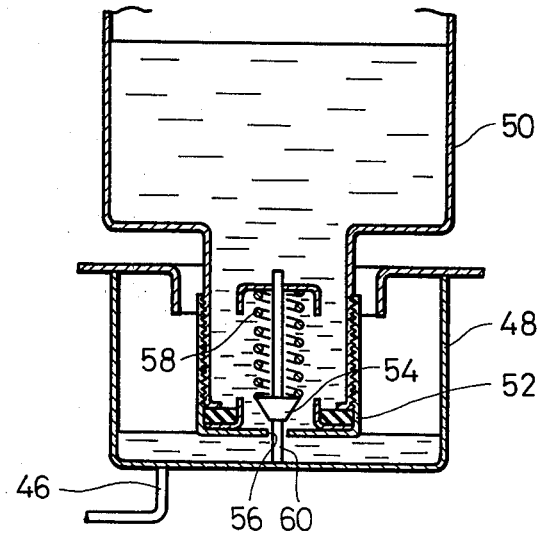
FIG. 4 is an enlarged vertical sectional view showing in detail a second oil level setting means of the oil burner shown in FIG. 1.

The first oil level setting means 12 is constructed as shown in FIG. 3. The oil level setting means 12 includes a fuel oil reservoir 30 which is provided with an overflow pipe means 32 extending through the substantially central portion of a bottom wall thereof into the reservoir; so that an excess of fuel oil introduced in the reservoir 30 may automatically return through the overflow pipe means 32 to the storage tank 26 to keep the surface of a fuel oil in the reservoir constant at a predetermined level. The overflow pipe means 32 is disposed in such a manner that the lower end thereof is constantly immersed in a fuel oil received in the storage tank 26. The reservoir 30 is provided at the bottom portion thereof with an opening 34 and at the lower portion of a side wall thereof when an opening 36. A rising pipe 38 is securely fitted at the upper end thereof in the opening 34 and is connected at the lower end thereof to the pumping-up means 24, thus, a fuel oil is drawn up from the storage tank 26 by the pumping-up means 24 and is guided through the rising pipe 28 to the reservoir 30 of the first oil level setting means 12. The supply pipe 16 is securely fitted at one end thereof in the opening 36, the other end of the pipe 16 extending into the combustion means 14; thus, the pipe 16 is adapted to supply a fuel oil from the reservoir 30 therethrough to the combustion means 14. The supply pipe 16 is disposed in such a manner that the end thereof extending into the combustion means 14 terminates at a position above any level of a fuel oil to be set in the first oil level setting means 12, so that a fuel oil may be not supplied from the reservoir 30 to the combustion means 14 unless the damper means 22 is opened. The reservoir 30 is also provided at an upper wall thereof with an opening 40, in which the ramification pipe 18 is securely fitted. Accordingly, it should be noted that the first oil level setting means 12 is airtightly constructed except that the upper space portion thereof is communicated to the air duct 20 through the ramification pipe 18.

Reference numeral 42 designates a motor means for actuating the pumping-up means 24, which is preferably connected through a drive shaft thereof to the fan to allow the pumping-up means and the fan to be simultaneously actuated.

The oil burner 10 is provided at the lower portion thereof with a second oil level setting means 44 communicated through a connection pipe 46 to the storage tank 26. In the embodiment, the second oil level setting means comprises a fuel oil receiver 48 and a fuel oil supply tank 50 invertedly fitted in the receiver 48 and acts to keep the level of a fuel oil in the receiver 48 substantially constant at a predetermined height. The supply tank 50 has a mouth covered with a cap 52, which is provided therein with a valve 54 constantly forced against an opening 56 thereof by a spring 58, as shown in detail in FIG. 4. When the supply tank 50 is invertedly fitted in the receiver 48, a rod 60 of the valve 54 engages with a bottom wall of the receiver to push up the valve 54 against the force of the spring 58, thus, a fuel oil in the tank 50 is supplied through the opening 56 to the receiver 48. When the level of a fuel oil in the receiver reaches the opening 56 or rises slightly above the opening, the supply of a fuel oil from the tank 50 to the receiver 48 is interrupted; because an air may not enter the tank 50 through the opening 56 any longer. While, when a fuel oil in the receiver 48 is supplied through the pipe 46 to the storage tank 26, so that the level of a fuel oil lowers below the opening 56; an air flows through the opening into the tank 50 to allow a fuel oil in the tank to be supplied to the receiver 48 until the level of a fuel oil reaches the opening 56 or rises slightly above it. Thus, the level of a fuel oil in the receiver is kept substantially constant at the position of the opening 56, so far as a fuel oil is in the tank 50.

As mentioned above, in the embodiment the storage tank 26 is communicated to the second oil level setting means 24, so that the pumping-up means 24 may be disposed in the storage tank; in addition, the pumping-up means may be considered to be substantially integrated with the first oil level setting means 12. This results in the construction of an oil burner being compact. Further, the second oil level setting means is disposed at a position below the first oil level setting means, i.e., a position considerably lower than the end of the supply pipe 16 extending into the combustion means, therefore, a fuel oil falls by gravity from the first oil level setting means through the rising pipe 18 into the storage tank 26 when the oil burner is not used. Thus, even if the oil burner is somewhat inclined, the spill of an oil in the oil burner is effectively prevented.

The first oil level setting means 12, as shown in FIG. 3, may be constructed to also have a function of varying the supply rate of a fuel oil to be supplied from the reservoir 30 to the combustion means 14 without affecting the rate of an air flowing through the air duct 20. The overflow pipe means 32 is composed of a lower pipe member 64 having an upper end securely fitted in an opening 66 provided at the bottom wall of the reservoir 30 and a lower end constantly immersed in a fuel oil received in the tank 26, and an upper pipe member 68 slidably inserted into the lower pipe member 64. The upper pipe member 68 has a lever pivotably connected to the upper portion thereof, which is linked to one end of a shaft 72 horizontally extending. The other end of the shaft 72 extends through the side wall of the reservoir 30 and is securely fitted in a rotatable operation knob 74 (FIG. 1) provided at the outside of the reservoir 30. When turning the knob 74 to actuate the shaft 72, the lever 70 allows the upper pipe member 68 to be finely moved in the vertical direction, to thereby vary the level of a fuel oil in the reservoir 30. The variation in level of a fuel oil allows an oil pressure applied on the inlet portion of the supply pipe 16 to be varied, and allows the difference in height between the level of a fuel oil in the reservoir 30 and the outlet portion of the supply pipe 16 to be varied; so that the rate of a fuel oil may be varied which is supplied from the reservoir through the supply pipe to the combustion means 14. Thus, the supply rate of a fuel oil may be varied as desired without affecting the flow rate of an air. In FIG. 3, the upper pipe member 64 is moved by the lever means, however, it may be moved by rack and pinion means similar to those employed in another embodiment shown in FIG. 5 detailedly explained hereinafter.

Where the overflow pipe means 32 is composed of the two pipe members 64 and 68, a fuel oil leaks downward through a gap between the pipe member 64 and 68; however, such leakage does not cause any problem because the rate of a fuel oil drawn up from the storage tank 26 to the reservoir 30 by the pumping-up means 24 is high. In addition, it should be noted that the overflow pipe means 32 may be composed of a single pipe member where an oil seal means such as a O-ring is interposed between the overflow pipe means and the reservoir 30 so that the former may slidably move through the seal in the vertical direction with respect to the latter. Such construction results in also preventing the leakage of a fuel oil encountered with the overflow pipe means composed of two pipe members.

The operation of the oil burner as illustrated in FIGS. 1 to 4 will now be explained.

When driving the motor means 42, it allows the fan (not shown) to be actuated, and also allows the pumping-up means 24 to be simultaneously actuated to introduce a fuel oil in the second oil level setting means 44 through the rising pipe 38 to the reservoir 30 of the first oil level setting means 12. When the level of a fuel oil having been introduced into the reservoir 30 is beyond the upper end of the overflow pipe means 32, an excess of fuel oil returns through the overflow pipe means to the storage tank 26; so that the level of a fuel oil in the reservoir 30 may be kept constant at the position of the upper end of the overflow pipe means 32. At this time, a fuel oil in the reservoir 30 is not yet supplied to the combustion means 14, because the end of the supply pipe 16 extending into the combustion means is positioned constantly above the upper end of the overflow pipe means 32 and the damper means is not yet opened. Thus, in the present invention, it is not required to provide an on-off valve in the supply pipe 16.

Then, when turning the knob 28 to open the damper means 22, an air is supplied through the damper means 22 and the air duct 20 to the combustion means 14 by the fan. Simultaneously, a part of the air is introduced from the air duct through the ramification pipe 18 into the first oil level setting means 12, to thereby apply the pressure onto the surface of an oil in the reservoir 30. The air pressure acts to lower the level of an oil in the reservoir 30; because the lower end of the overflow pipe means 32 is constantly immersed in a fuel oil in the storage tank 26, so that the pressure may not substantially escape from the reservoir 30. While, the pumping-up means 24 constantly supplies a fuel oil from the storage tank 26 to the first oil level setting means 12 to keep the level of an oil in the reservoir 30 constant. Therefore, the air pressure applied onto the surface of an oil in the reservoir 30 gradually rises; thus, a fuel oil in the reservoir 30 starts to flow through the supply pipe 16 to the combustion means 14 because the end of the pipe 16 extending into the combustion chamber is subjected to an atmospheric pressure. The supply rate of a fuel oil from the reservoir 30 to the combustion means depends on the air pressure applied onto the surface of a fuel oil in the reservoir, namely, the flow rate of an air controlled by the damper means 22; thus, the supply rate of a fuel oil as well as the flow rate of an air may be controlled by the damper means 22.

Where it is desired to vary only the supply rate of a fuel oil from the reservoir 30 to the combustion means 14 without changing the flow rate of an air, the knob 74 is turned to actuate the lever 70 through the shaft 72, to thereby finely move the upper end of the overflow pipe means 32 in the vertical direction.

Figure 5:
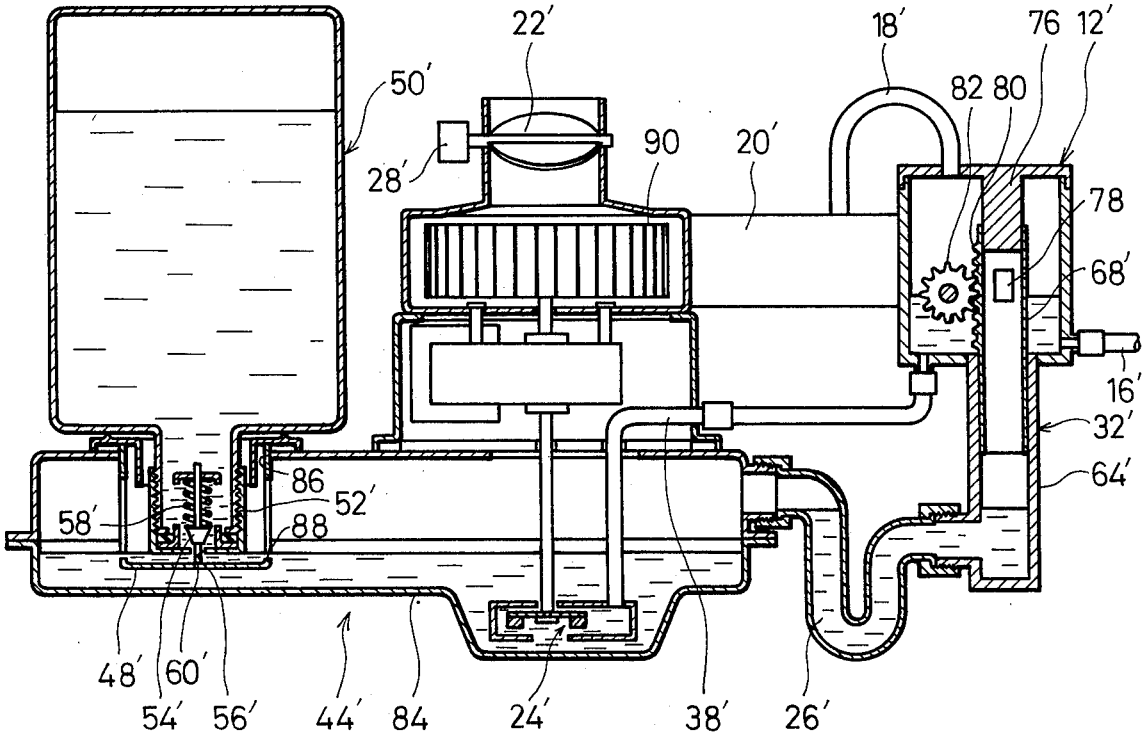
FIG. 5 is an elevational view partly in section showing another embodiment of an oil burner according to the present invention.

FIG. 5 illustrates another embodiment of an oil burner according to the present invention. An oil burner 10' of the embodiment is constructed in such a manner that a fuel oil pumping-up means 24' is installed in a second oil level setting means 44' to allow a fuel oil to be normally supplied even at the time of starting the operation of the pumping-up means as well as to prevent a fuel oil from spilling in a combustion means when tilting the oil burner. A first oil level setting means 12' includes a fuel oil reservoir 30° which is connected thereto one end of a fuel oil supply pipe 16' for feeding a fuel oil from the reservoir to a combustion means (not shown) which is constructed similarly to the combustion means 14 of the embodiment mentioned above. The other end of the supply pipe 16' extends into the combustion means and terminates at a position above any level of a fuel oil to be set in the reservoir 30'. The reservoir 30' is also connected thereto a pipe 38' for guiding a fuel oil drawn up from the second oil level setting means 44' to the reservoir 30' by means of the pumping-up means 24' provided in the second oil level setting means 44'. The first oil level setting means also includes an overflow pipe means 32' extending through a bottom wall of the reservoir 30' into the reservoir, which may be composed of a single pipe member or may be composed of a lower pipe member 64' and an upper pipe member 68' slidably fitted in the lower pipe member 64', as shown in FIG. 5. The lower pipe member 64' has an upper end tightly fitted in an opening 66' provided at the bottom wall of the reservoir 30' and has a lower portion constantly filled with a fuel oil. The upper pipe member 68' has a lower portion slidably fitted in the lower pipe member 64' and has an upper end slidably fitted on a projection 76 provided at the lower surface of a top wall of the reservoir 30', so that the upper pipe member 68' may be stably supported in the reservoir 30'. The upper pipe member 68' is provided at the upper portion thereof with an opening 78 which acts to return an excess of fuel oil introduced in the reservoir 30' therethrough to the lower portion of the lower pipe member 64', so that the surface of a fuel oil in the reservoir 30' may be kept at a predetermined level.

The oil burner of the embodiment also may be constructed so as to vary the rate of a fuel oil to be supplied from the first oil level setting means 12' to the combustion means without affecting the flow rate of an air. The upper pipe member 68' is provided on the side surface thereof with a rack 80 which engages with a pinion 82 mounted on a shaft 72' horizontally extending within the reservoir 30'. One end of the shaft 72' extends through the side wall of the reservoir 30' and is securely fitted in a rotatable operation knob (not shown) provided at the outside of the reservoir 30', similarly to the knob 74 of the embodiment described above. When turning the knob to actuate the pinion 82 through the shaft 72', the rack 80 allows the upper pipe member 68' to be finely moved in the vertical direction, to thereby vary the level of a fuel oil in the reservoir 30'; thus, only the supply rate of a fuel oil may be varied. It is a matter of course that the movement of the overflow pipe means 32' may be achieved by a lever linkage as shown in FIG. 3 which illustrates the overflow pipe means of the embodiment described above.

In the embodiment of FIG. 5, the second oil level setting means 44' may be considered to comprise a vessel 84, a receiver 48' and an oil supply tank 50' invertedly fitted in the receiver 48'; the receiver being attached in an opening 86 provided at an upper wall of the vessel 84. The tank 50' has a cap 52' constructed in the substantially same manner as that of the embodiment described above. The cap 52' is provided with a valve 54 constantly forced against an opening 56' of the cap by a spring 58'. When the tank 50' is invertedly fitted in the receiver 48', a rod 60' of the valve 54' engages with a bottom wall of the receiver 48' to push upward the valve 54' against the force of the spring 58'; so that a fuel oil in the tank 50' is supplied through the opening 56' and an opening 88 of the receiver 48' to the vessel 84. When the level of a fuel oil in the vessel 84 reaches the opening 56' or rises slightly above it, the supply of a fuel oil from the tank 50' to the vessel 84 is interrupted; because an air may flow through the opening 56' into the tank 50' no longer. When the level of a fuel oil lowers below the opening 56' due to the supply of a fuel oil from the vessel 84 to the reservoir 30' by means of the pumping-up means 24', an air flows through the opening 56' into the tank 50' to allow a fuel oil in the tank 50' to be supplied in the vessel 84 until the level of a fuel oil in the vessel reaches the opening 56' or rises slightly above it, thus, the level of a fuel oil in the vessel is kept substantially constant. The rod 60' may be attached to the bottom wall of the receiver 48' to engage with the valve. A filter is preferably attached to the opening 88 of the receiver 48' to remove foreign materials contained in a fuel oil such as dust, water and the like. However, when such filter is not required, the receiver 48' is capable of being eliminated from the second oil level setting means 44'. In such case, the vessel 84 may be constructed so as to directly receive the tank 50', and the rod 60' may be attached to the valve 54' or the vessel 84 to actuate the valve.

In FIG. 5, reference numeral 26' designates a U-shaped pipe acting as an oil storage means which is connected at one end thereof to the vessel 84 of the second oil level setting means and at the other end thereof to the lower portion of the lower pipe member 64' of the first oil level setting means. Therefore, the lower portion of the lower pipe member 64' may be considered to be constantly immersed in a fuel oil to be pumped up to the first oil level setting means 12'; and the first and second oil level setting means, the pipe 38', and the pipe 26' may be considered to form a system for circulating a fuel oil. The storage means 26' is preferably formed by bending a pipe of a larger diameter into a U-shape to prevent an airlock phenomenon from occurring therein. Reference numerals 18', 20', 22' and 42' indicate a ramification pipe, an air duct, a damper means and a motor means, respectively, which are constructed in such a manner as those of the embodiment mentioned above. Reference numeral 88 designates a fan of the type of supplying a large amount of air under a low pressure such as a multi-blade fan for forcedly supplying an air from the damper means 22' through the air duct 20' to the combustion means.

Thus, the oil burner shown in FIG. 5 may adequately supply a fuel oil without occurring any troubles such as an airlock and the like even at the time of starting of the pumping-up means at which a large volume of fuel oil is supplied to the first oil level setting means, because the pumping-up means is installed in the second oil level setting means to which a fuel oil is directly supplied from the tank 50'. Further, the spill of a fuel oil is effectively prevented even if the oil burner is somewhat tilted at the time when the oil burner is not used, because a fuel oil in the first oil level setting means returns by gravity through the pipe 38' to the second oil level setting means positioned below the first oil level setting means.

As described above, in the oil burner according to the present invention, the end of the fuel oil supply pipe extending into the combustion means is positioned above any level of a fuel oil to be set in the first oil level setting means; thus, the oil burner is capable of incorporating therein a fan of the type of supplying a large amount of air under a low pressure such as a multi-blade fan, to thereby remarkably restrain the generation of a noise and to allow the flow rate of an air and the supply rate of a fuel oil to be controlled with respect to each other. In addition, the oil burner of the present invention is airtightly constructed in the simple manner that the overflow pipe means is constantly immersed at the lower end thereof in a fuel oil to be pumped up to the first oil level setting means, to thereby allow the pressure applied on the surface of a fuel oil in the first oil level setting means to be gradually increased and to also allow a fan supplying a large amount of air under a low pressure to be incorporated.

Further, in the oil burner of the present invention, the first oil level setting means is disposed at a position above the second oil level setting means directly connected to the oil supply tank. Therefore, the first oil level setting means empties when stopping the motor means, because a fuel oil in the reservoir returns by gravity to the second oil level setting means; thus, the spill of a fuel oil in the oil burner is effectively prevented even if the oil burner is somewhat inclined.

Furthermore, according to the present invention, the overflow pipe means is movable in the vertical direction, thus, it is possible to vary the supply rate of a fuel oil as desired without affecting the flow rate of an air.

While preferred embodiments of the invention have been described, obviously modifications and variations are possible in light of the above teachings. It is therefore to be understood that within the scope of the appended claims, the invention may be practiced otherwise than as specifically described.

What is claimed is:

1. An oil burner of the type of pumping up a fuel oil comprising:

a combustion means;

an air supply means for supplying an air to said combustion means;

a first oil level setting means of an airtight type for keeping the surface of a fuel oil introduced therein constant at a predetermined level, said first oil level setting means including a fuel oil reservoir connected through a fuel oil supply pipe to said combustion means and communicated at the upper space portion thereof through a ramification pipe to said air supply means so that the pressure of an air flowing through said air supply means may be applied onto the surface of a fuel oil in said reservoir;

a second oil level setting means installed at a position below said first oil level setting means which keeps the surface of a fuel oil therein substantially constant at a predetermined level;

a pumping-up means for drawing up a fuel oil supplied from said second oil level setting means to said first oil level setting means;

said first oil level setting means further including an overflow pipe means connected to said reservoir which has an upper portion for overflowing an excess of fuel oil introduced in said reservoir positioned below the end of said fuel oil supply pipe extending into said combustion means and has a lower end immersed in a fuel oil to be pumped up to said first oil level setting means.

2. An oil burner as defined in claim 1 wherein said oil burner further comprises a fuel oil storage tank communicated to said second oil level setting means, said second oil level setting means includes a receiver and a fuel oil supply tank invertedly fitted in said receiver, and said lower end of said overflow pipe means is immersed in a fuel oil in said storage tank.

3. An oil burner as defined in claim 2 wherein said overflow pipe means is connected to said reservoir in such a manner that said excessive fuel oil overflowing portion of said overflow pipe means is movable in the vertical direction, to thereby allow the rate of a fuel oil to be supplied to said combustion means to be varied without affecting the rate of an air flowing through said air supply means.

4. An oil burner as defined in claim 3 wherein said overflow pipe means is composed of a lower pipe member having an upper end fixedly connected to a bottom wall of said reservoir and having a lower end immersed in a fuel oil in said storage tank, an upper pipe member slidably inserted into said lower pipe member which has an upper end extending into said reservoir, and said overflowing portion is provided at said upper pipe member.

5. An oil burner as defined in claim 3 wherein said overflow pipe means is composed of a single pipe member connected to said reservoir so as to be slidably moved in the vertical direction with respect to said reservoir and an oil seal is interposed between said overflow pipe means and said reservoir.

6. An oil burner as defined in any of claims 3, 4 and 5 wherein said excessive fuel oil overflowing portion of said overflow pipe means is moved in the vertical direction by means of a lever means.

7. An oil burner as defined in any of claims 3, 4 and 5 wherein said excessive fuel oil overflowing portion of said overflow pipe means is moved in the vertical direction by means of rack and pinion means.

8. An oil burner as defined in claim 1 wherein said oil burner further comprises a fuel oil storage means connected between said second oil level setting means and said overflow pipe means, said second oil level setting means includes a vessel for receiving therein a fuel oil to be pumped up to said first oil level setting means and a fuel oil supply tank invertedly fitted in said vessel, and said lower end of said overflow pipe means is immersed in a fuel oil in said storage means.

9. An oil burner as defined in claim 8 wherein said storage means comprises a substantially U-shaped pipe.

10. An oil burner as defined in claim 8 wherein said overflow pipe means is connected to said reservoir so that said excessive fuel oil overflowing portion of said overflow pipe means is movable in the vertical direction, to thereby allow the rate of a fuel oil to be supplied to said combustion means to be varied without affecting the rate of an air flowing through said air supply means.

11. An oil burner as defined in claim 10 wherein said overflow pipe means is composed of a lower pipe member having an upper end fixedly connected to a bottom wall of said reservoir and having a lower end immersed in a fuel oil in said storage means, an upper pipe member slidably inserted into said lower pipe member which has an upper end extending into said reservoir, and said overflowing portion is provided at said upper pipe member.

12. An oil burner as defined in claim 10 wherein said overflow pipe means is composed of a single pipe member connected to said reservoir so as to be slidably moved with respect to said reservoir and an oil seal is interposed between said overflow pipe means and said reservoir.

13. An oil burner as defined in claim 10, 11 or 12 wherein said excessive fuel oil overflowing portion of said overflow pipe means is moved in the vertical direction by means of a lever means.

14. An oil burner as defined in claim 10, 11 or 12 wherein said excessive fuel oil overflowing portion of said overflow pipe means is moved in the vertical direction by means of rack and pinion means.

15. An oil burner as defined in claim 13 wherein said upper end of said overflow pipe means is slidably fitted on a projection provided at the lower surface of an upper wall of said reservoir.

16. An oil burner as defined in claim 8 wherein said vessel is provided with a receiver in which said supply tank is adapted to be invertedly fitted.

17. An oil burner as defined in claim 16 wherein said receiver is provided at an opening thereof with a filter means.

18. An oil burner as defined in claim 14 wherein said upper end of said overflow pipe means is slidably fitted on a projection provided at the lower surfaces of an upper wall of said reservoir.

* * * * *